United States Patent [19]

Broadie

[11] Patent Number: 5,056,149

[45] Date of Patent: Oct. 8, 1991

[54] MONAURAL TO STEREOPHONIC SOUND TRANSLATION PROCESS AND APPARATUS

[76] Inventor: Richard G. Broadie, P.O. Box 615, Palm Springs, Calif. 92263

[21] Appl. No.: 519,283

[22] Filed: May 4, 1990

Related U.S. Application Data

[63] Continuation-in-part of Ser. No. 22,580, Mar. 10, 1987, abandoned, which is a continuation-in-part of Ser. No. 833,820, Feb. 26, 1986, abandoned.

[51] Int. Cl.[5] ..... H04R 5/00

[52] U.S. Cl. ..... 381/17

[58] Field of Search ..... 381/17, 63, 1

[56] References Cited

U.S. PATENT DOCUMENTS

| | | | |
|---|---|---|---|
| 3,048,072 | 8/1962 | Hanert | 381/17 |
| 3,087,988 | 4/1963 | Somer | 381/17 |
| 4,625,326 | 11/1986 | Kitzen et al. | 381/17 |

*Primary Examiner*—Forester W. Isen

*Attorney, Agent, or Firm*—Blakely, Sokoloff, Taylor & Zafman

[57] ABSTRACT

A circuit for generating a multi-channel audio output from a single channel input. In the circuit, the single channel input may include gain control. The circuit divides the single channel input into at least two signals, each of which may have applied to it gain control, time delay, tone control and/or phase inversion. The gain controlled, time delayed, phase inverted and/or tone controlled signals are each input to an amplifier to create the multi-channel audio output.

21 Claims, 11 Drawing Sheets

MONAURAL TO STEREOPHONIC SOUND TRANSLATION PROCESS AND APPARATUS

This is a continuation-in-part of application Ser. No. 022,580 filed Mar. 10, 1987, now abandoned, which is a continuation-in-part of the parent application Ser. No. 833,820 filed Feb. 26, 1986 which has been abandoned.

BACKGROUND OF THE INVENTION

This invention relates to a sound translation system and more particualrly to a system that is specifically configured for use in the translation of a single channel (monaural or mono) audio signal to a multi-channel (stereophonic or stereo; quadraphonic; surround sound) audio signal for presentation in a variety of forms.

Specifically, the invention is directed to uniquely employing non-reverberative, linear, high-fidelity, variable, digital time delay means for the production of pleasing and realistic multi-channel audio output information from monaural input which may originate from live performance or such as mechanical, magnetic, optical, digital or broadcast audio reproduction means. Pre-existing stereo channels may be individually utilized or summed whereby monaural input is provided to the invention for quadraphonic or surround sound applications.

This invention is NOT a reverberative device and presupposes sufficient reverberation content to exist in monaural input audio source material. It is a feature of the invention to achieve a stereo-like output from mono input without significantly adding to reverberation content in output signal.

Current research indicates that the human brain manifests an active role in the processing and interpretation of of binaural audio information whereby factors such as phase, arrival time and amplitude are organized as to provide the listener with perception of sonic dimensions. Since it is binaural stimulus reception, and not production of sound that is responsible for perception of depth and direction, stereophonic sound may be said to only exists in a listener's brain.

When considering the natural auditory phenomenon of echo, a simple geometric rule prevails: The shortest distance between two points is a straight line. Accordingly, the distance that a given sound must travel to a listener, from a given source, is always shorter from a direct route than from a reflective route. Traveling the greater distance, the reflective signal is always of greater delay time and less amplitude than is the direct signal. In nature, therefore, it may be said that an INVERSE relationship always exists between delay time and amplitude.

As the principle of the invention, a DIRECT relationship is established between delay time and amplitude. That is to say, the time delayed signal is ALWAYS of greater amplitude than the undelayed signal. By this unique means of the invention, the listener is provided an amplitude/delay binaural audio stimulus which is in conflict with that found in nature.

In conjunction with the above principle, many embodiments of the invention uniquely employ phase inverted paired signals (PIPS), which may not be found in nature, whereby two signals, of equal frequency content and amplitude but 180 degrees out of phase with one another, are uniquely presented from separate output channels, as to produce the means for controlling width and/or depth perceptual dimensions and timbre-related separation effects while also providing the means for achieving excellent monaural compatability characteristics.

Frequemcy filtering is employed in several embodiments of the invention in the context of the above cited time, amplitude and phase realatinships.

It is not known if the means of the invention produces true stereo from mono input. It is the purpose of the invention to utilize relationships not found in nature whereby the listener's brain is caused to perceive a pleasant and realistic three dimensional sonic effect not unlike true stereophonic sound.

SUMMARY OF THE INVENTION

In accordance with the invention, the means for presenting an improved multi-channel audio output from single channel input include;

One processing input channel adapted for receiving a single channel audio input which may include gain control means;

One or more processing channels which includes gain control means;

One or more processing channels which includes time delay means (of non-reverberative type herein above described);

One or more processing channels which may include phase inversion means;

One or more processing channels which may include tone control means;

One or more processing channels which may include some or all of the above described features.

Means of utilizing one or more of said processing channels for presentation in one channel of multi channel audio output system.

Means of utilizing two or more of said processing channels for persentation in second channel of multichannel output audio system.

Other objects, features and advantages of the invention will be apparent from the following detailed description when used in conjunction with the accompanying drawings.

BRIEF DESCRIPTION OF THE DRAWINGS

FIGS. 3 through 10 are block diagrams of embodiments of the invention which provide means of producing a two channel audio output from a single channel audio input wherein:

FIGS. 3 and 4 utilize one time delay means, one phase inversion means and five gain control means.

FIGS. 5 and 6 utilize two time delay means, two phase inversion means and seven gain control means.

FIGS. 7 and 8 utilize one time delay means, one phase inversion means, four gain control means and three tone control means.

FIGS. 9 and 10 utilize two time delay means, two phase inversion means, seven gain control means and four tone control means.

DETAILED DESCRIPTION

Figures 1, 2:
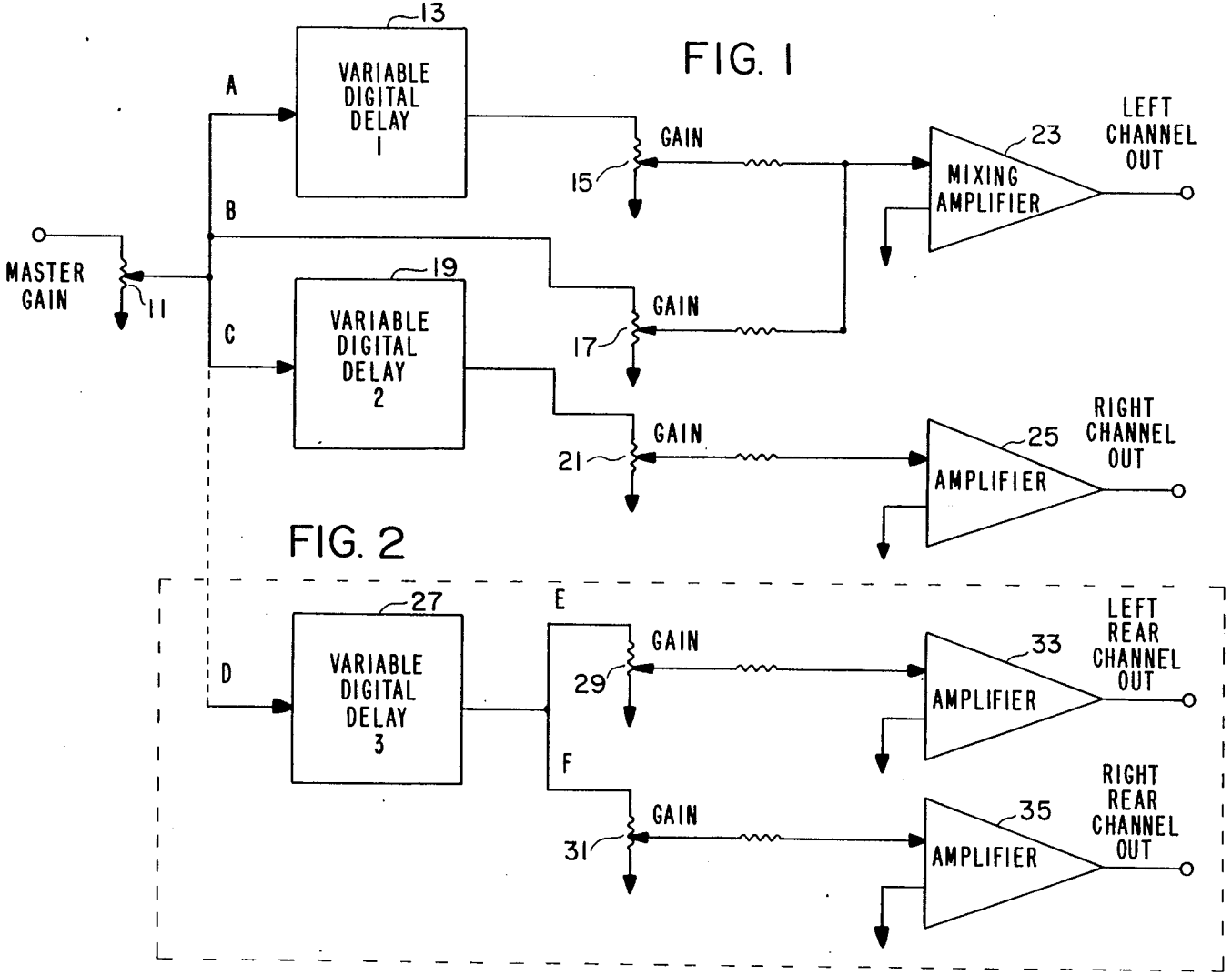
FIG. 1 is a block diagram of an embodiment of the invention which utilizes two time delay means and four gain control means in the production of a two channel audio output from a single channel audio input.
FIG. 2 is a block diagram of an embodiment of the invention which utilize three time delay means and six gain control means in the production of a four channel audio output from a single channel audio input.

Referring now to the configuration of FIG. 1, the monaural input signal is gain controlled by potentiometer 11 and divided into three equal signals, A, B and C. whereby:

Circuitry 13 and potentiometer 15 impart a first variable digital time delay and gain control to signal A;

Potentiometer 17 imparts gain control to signal B;

Circuitry 19 and potentiometer 21 impart a second variable digital time delay and gain control to signal C;

Mixing amplifier 23 mixes said delayed and gain controlled signal A and said gain controlled signal B. Said signals are amplified to produce the output of the first of two audio channels;

Time delayed, gain controlled signal C is amplified by amplifier 25 to produce the output of the second of two audio channels.

A listener, hearing the two audio channels, perceives the resulting stereophonic audio output information as being realistic and pleasant in accordance with the purpose of the invention.

In a manner well known in the presentation of stereophonic sound, the output of the two audio channels is presented from two speakers which are placed before and to either side of listener.

The following parameters are mandated in the operation of the apparatus of FIG. 1;

1. In accordance with the principle of the invention, undelayed signal B is always the signal of least amplitude.

2. The inventor has determined that delaying signal C between 0.2 and 60 milliseconds and delaying signal A between 5 and 90 milliseconds produces satisfactory results. Signal A, is always delayed more than is signal C.

3. Accordingly, information is presented to the listener in such a manner that signal information in one output channel simultaneously leads and lags that same information as presented in the output of the second channel.

The apparatus of FIG. 1 may be advantageously applied in situations wherein monaural compatability is not essential. Should the listener wish to reproduce the input mono signal with the circuitry of FIG. 1, he need only play back the output of signal C.

Details concerning the construction of non-reverberative, linear, high-fidelity, variable, digital time delay circuits 13 and 19 as well as mixing amplifier 23 and amplifier 25 would be readily apparent to a person skilled in the art.

FIG. 2 includes the circuitry of FIG. 1 plus additional circuitry whereby a four channel output may be produced from a single channel input.

Referring now to the configuration of FIG. 2, the monaural input signal is gain controlled by potentiometer 11 and is divided into four equal signals, A, B, C and D. whereby:

Circuitry 13 and potentiometer 15 impart a first variable digital time delay and gain control to signal A;

Potentiometer 17 imparts gain control to signal B;

Circuitry 19 and potentiometer 21 impart a second variable digital time delay and gain control to signal C;

Circuitry 27 imparts a third variable digital time delay to signal A;

Potentiometer 29 imparts gain control to signal E;

Potentiometer 31 imparts gain control to signal F;

Mixing amplifier 23 mixes said delayed and gain controlled signal A and said gain controlled signal B. Said signals are amplified to produce the output of the first of four audio channels;

Time delayed, gain controlled signal C is amplified by amplifier 25 to produce the output of the second of four audio channels;

Gain controlled signal E is amplified by amplifier 33 to produce the output of the third of four audio channels;

Gain controlled signal F is amplified by amplifier 35 to produce the output of the fourth of four audio channels.

A listener hearing the four audio channels perceives the resulting quadraphonic audio output information as being realistic and pleasant in accordance with the purpose of the invention.

In a manner well known in the presentation of quadraphonic sound, the output of the first and second channels is presented before and to either side of the listener; the output of the third and fourth channels is presented behind and to either side of the listener.

The following parameters are mandated for the operation of the apparatus of FIG. 2:

1. In accordance with the principle of the invention, undelayed signal B is always the signal of least amplitude.

2. The inventor has determined that delaying signal C between 0.2 and 60 milliseconds and delaying signal A between 5 and 90 milliseconds produces satisfactory results. Signal A, is always delayed more than is signal C.

3. The inventor has further determined that delaying signal D between 5 and 30 milliseconds greater than Signal A produces satisfactory results. Signal D is always the most delayed signal.

Playback on the configuration of FIG. 2 provides a rich surround-sound feel wherein the dimensions of reality and enjoyment are greatly enhanced.

Details concerning the construction of non-reverberative, linear, high-fidelity, variable, digital time delay circuits 13, 19 and 27 as well as mixing amplifier 23 and amplifiers 25, 33 and 35 would be readily apparent to those skilled in the art.

The embodiments of FIGS. 3 through 10 pertain only to systems which employ the placement of two speakers before and to either side of the listener in a manner well known in the presentation of two channel or stereophonic sound.

It is known that, when an audio signal is divided into two in-phase signals of equal amplitude, and is presented to the listener by well known stereo means, the listener tends to perceive said signals as originating from a midpoint between the two individual speakers.

As also presented by well known stereo means, it has been found that when a signal is divided into two signals of equal amplitude which are 180 degree out of phase with one another, and each of said resultant signals is presented from a different stereo channel, the listener tends to perceive two separate signals as originating from lateral directions and not from a midpoint between the individual speakers. Hereinafter said process will be referred to as phase inversion and said phase inverted signals, as present in separate stereo channels, will, hereinafter, be referred to as phase inverted paired signals or PIPS.

FIGS. 3 through 10 of the invention employ said phase inverted paired signals advantageously whereby:

1. when summed into mono, in such instances as the reception of a stereo FM or TV signal by a monaural receiver, said PIPS cancel out, providing means for achieving monaural compatability;

2. when employed in undelayed circuitry, said PIPS tend to manifest production of increased perceptual width dimension;

3. when employed in delayed circuitry, said PIPS tend to manifest production of increased perceptual depth dimension;

4. when mixed with other signals of each channel, said PIPS add to or cancel said other signals in accordance with polarity, whereby perceptual separation may be caused to occur in a manner related to a given sound source's timbre characteristics;

5. when employed in context of the aformentioned principle of the invention wherein the delayed signal is always of greater amplitude, said phase inverted paired signals (PIPS) provide the means for producing and controlling a monaurally compatable output signal which, when presented by multi-channel means, provides the listener with a unique and dramatic stereo-like output.

Figure 3:
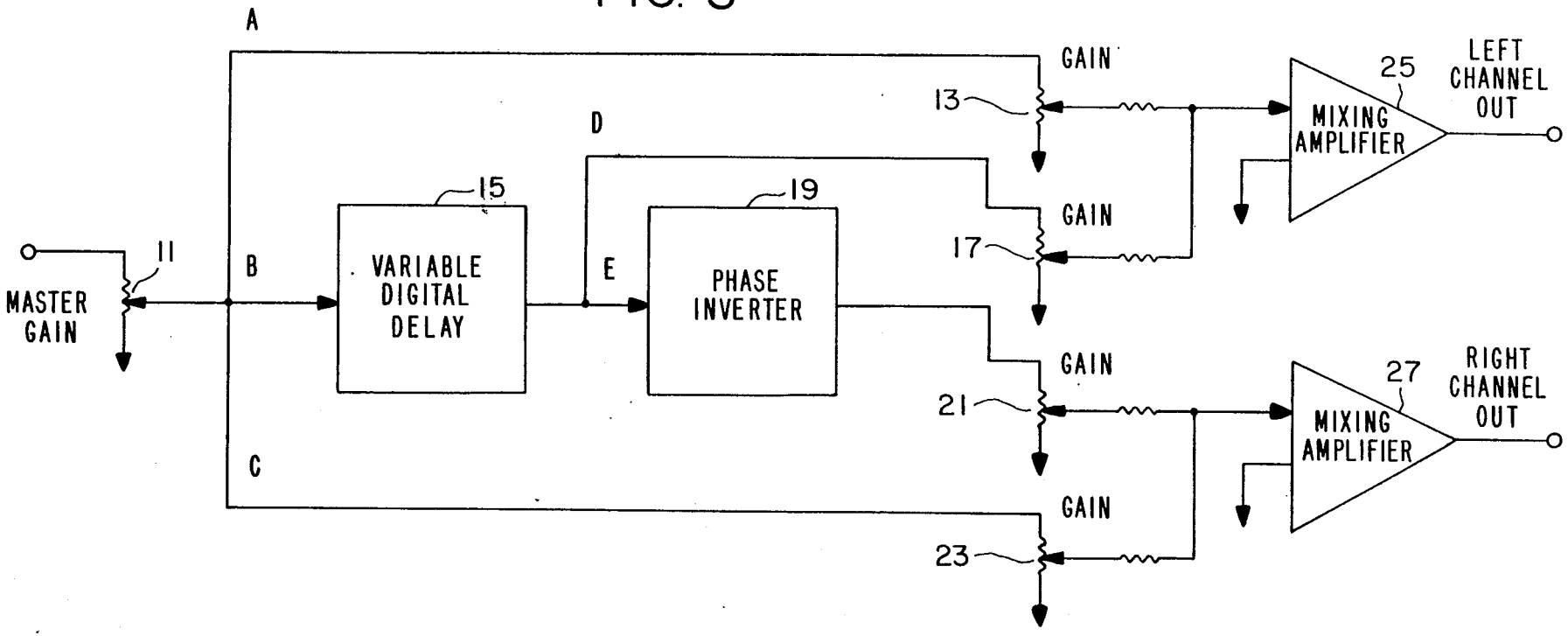

Referring now to the configuration of FIG. 3, the monaural input signal is gain controlled by potentiometer 11 and is divided into three equal signals, A,B and C. whereby:

Potentiometer 13 imparts gain control to signal A;

Circuitry 15 imparts variable digital time delay to signal B which is divided into two equal signals, D and E;

Potentiometer 17 imparts gain control to signal D;

Circuitry 19 and potentiometer 21 imparts phase inversion and gain control to signal E;

Potentiometer 23 imparts gain control to signal C;

Mixing amplifier 25 mixes and amplifies said gain controlled signal A and said gain controlled signal D;

Mixing amplifier 27 mixes and amplifies said phase inverted and gain controlled signal E and said gain controlled signal C.

A listener, hearing the two audio channels, perceives the resulting stereophonic audio output information as being realistic and pleasant in accordance with the purpose of the invention.

The following parameters are mandated for the operation of the apparatus of FIG. 3 whereby:

1. Being undelayed, signals A and C must be of least amplitude in a manner consistant with the principle of the invention.

2. In applications requiring monaural compatability, amplitude of signal D must equal amplitude of signal E, thereby establishing a phase inverted paired signal. Summation of the above output stereo signal results in the cancellation of PIPS signal D and E, thereby presenting only combined residual signals A and C as the monaural output.

3. The inventor has determined that delaying signal B between 0.2 and 60 milliseconds produces satisfactory results.

Figure 4:
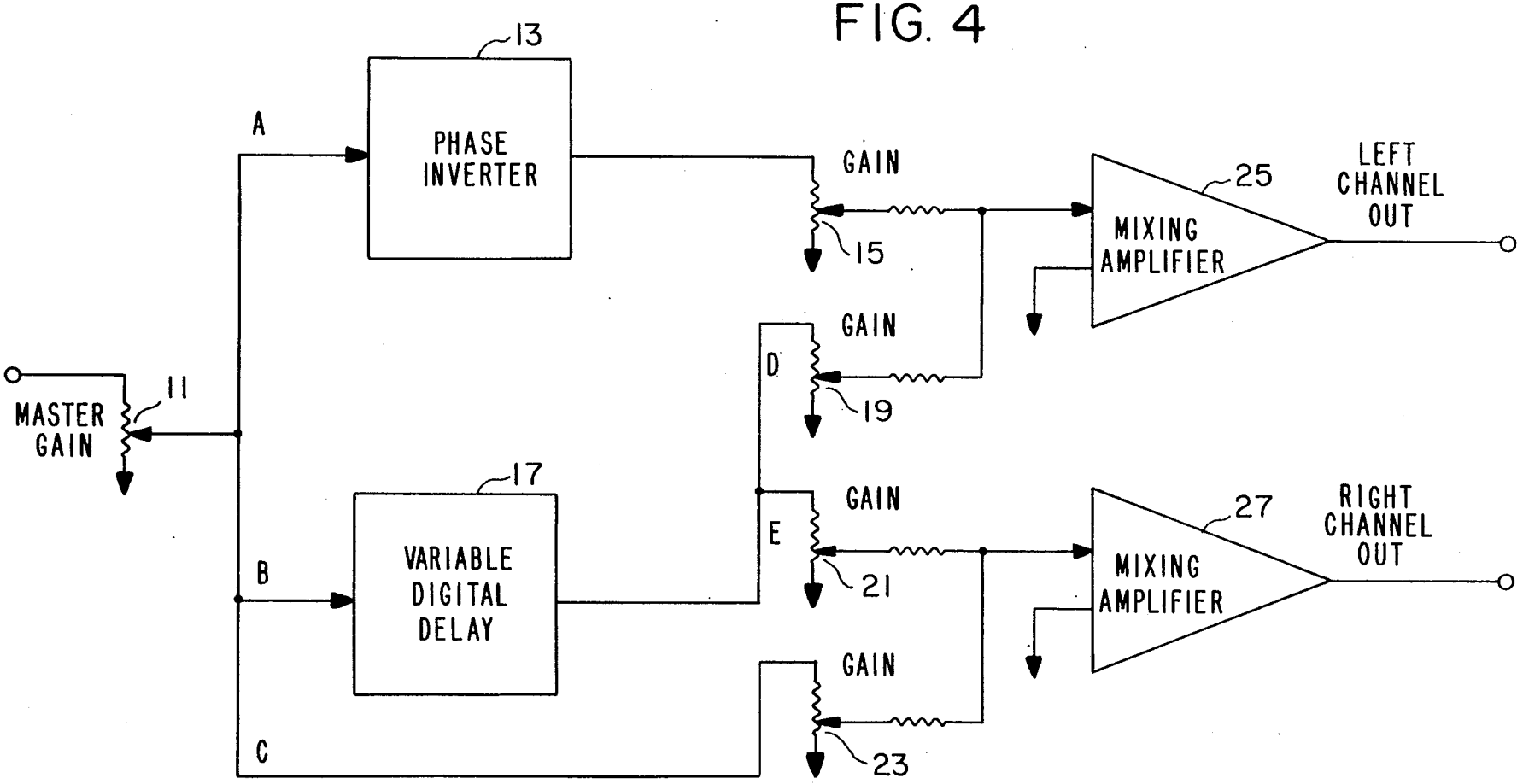

One advantage of this apparatus over that of FIG. 4 is in its capability of producing a perceptual depth dimension. A second advantage is that the undelayed signal remains when summed to mono. In applications such as VCR sound tracks, wherein synchronization between picture and sound is of the essence, this apparatus may prove advantageous.

Details concerning the construction of non-reverberative, linear, high-fidelity, variable, digital time delay circuit 15, phase inverter 19 and mixing amplifiers 25 and 27 would be readily apparent to a person skilled in the art.

Referring now to the configuration of FIG. 4, the monaural input signal is gain controlled by potentiometer 11 and is divided into three equal signals, A,B and C. whereby:

Circuitry 13 and potentiometer 15 imparts phase inversion and gain control to signal A;

Circuitry 17 imparts variable digital time delay to signal B which is then divided into two equal signals D and E;

Potentiometer 19 imparts gain control to signal D;

Potentiometer 21 imparts gain control to signal E;

Potentiometer 23 imparts gain control to signal C;

Mixing amplifier 25 mixes and amplifies said phase inverted and gain controlled signal A and said gain controlled signal D to produce the output of a first of two audio channels;

Mixing amplifier 27 mixes and amplifies said gain controlled signal E and said gain controlled signal C to produce the output of a second of two audio channels.

A listener, hearing the two audio channels, perceives the resulting stereophonic audio output information as being realistic and pleasant in accordance with the purpose of the invention.

The following parameters are mandated for the operation of the apparatus of FIG. 4:

1. Being undelayed, signals A and C must be of least amplitude, in a manner consistant with the principle of the invention.

2. In applications requiring monaural compatability, amplitude of signal A must equal amplitude of signal C thereby establishing a phase inverted paired signal. Summation of the above output stereo signal results in the cancellation of PIPS signal A and C, thereby presenting combined residual signals D and E as the monaural output.

3. The inventor has determined that delaying signal B between 0.2 and 60 milliseconds produces satisfactory results.

One advantage of this apparatus over that of FIG. 3 is in its capability of producing a perceptual width dimension. A second advantage is that when the delayed signal is summed as in monaural compatability applications, a monaural output is produced which may nearly equal the stereophonic output amplitude. (According to the principle of the invention, delayed signals are ALWAYS of greater amplitude than undelayed signals.)

Details concerning the construction of non-reverberative, linear, high-fidelity, variable, digital time delay circuit 17, phase inverter 13 and mixing amplifiers 25 and 27 would be readily apparent to a person skilled in the art.

Embodiments of FIGS. 5, 6, 9 and 10 employ two variable digital delay means whereby greater control of stereophonic imaging may be achieved. The principle disadvantage of these apparatuses is that of cost and increasing complexity in operation.

Figure 5:
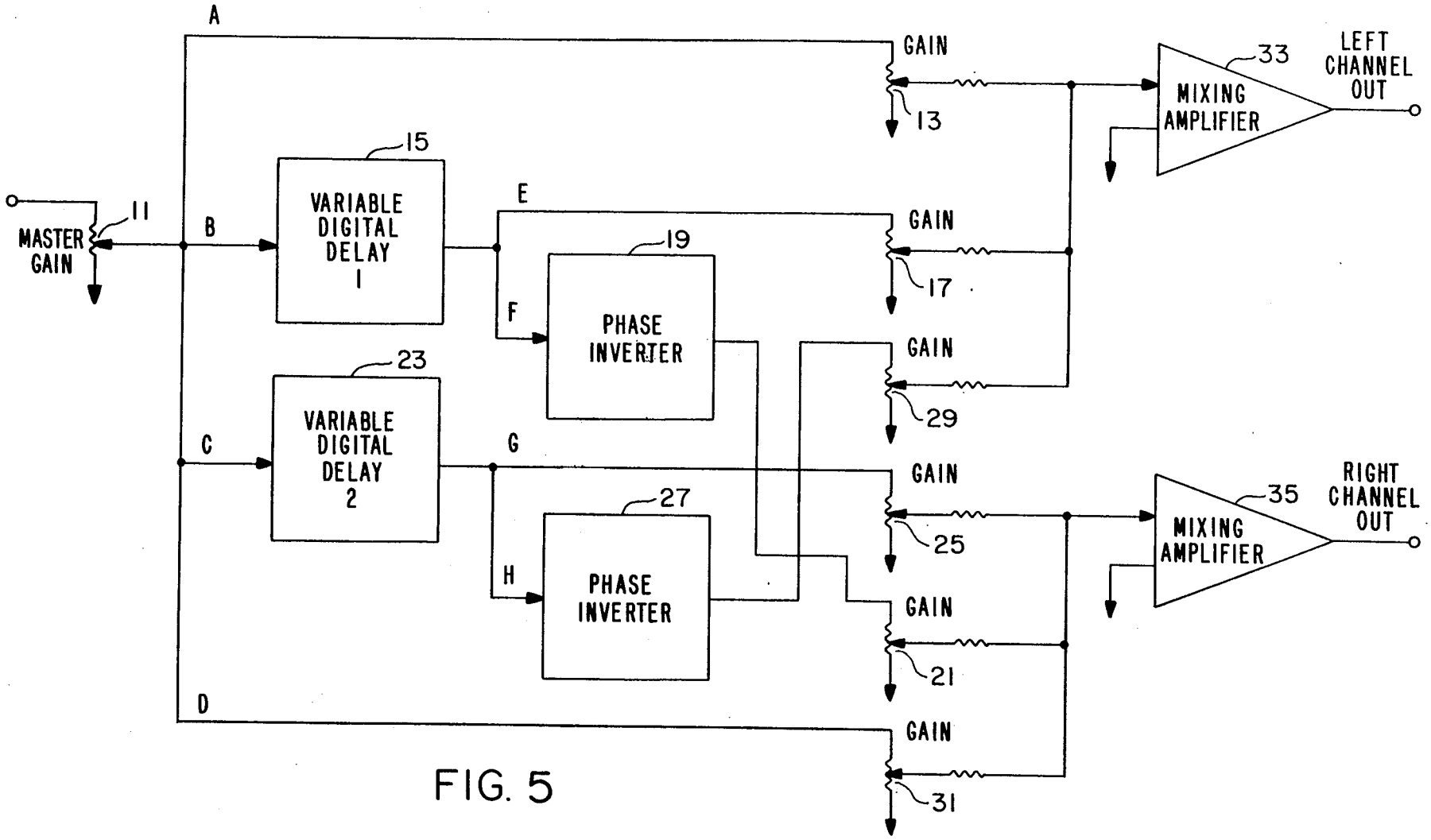

Referring now to the configuration of FIG. 5, the monaural input signal is gain controlled by potentiometer 11 and is divided into four equal signals, A,B,C and D. whereby:

Potentiometer 13 imparts gain control to signal A;

Circuitry 15 imparts a first variable digital time delay to signal B which is then divided into two equal signals, E and F;

Potentiometer 17 imparts gain control to signal E;

Circuitry 19 and potentiometer 21 impart phase inversion and gain control to signal F;

Circuitry 23 imparts a second variable digital time delay to signal C which is then divided into two equal signals G and H;

Potentiometer 25 imparts gain control to signal G;

Circuitry 27 and potentiometer 29 impart phase inversion and gain control to signal H.;

Potentiometer 31 imparts gain control to signal D;

Mixing amplifier 33 mixes and amplifies said gain controlled signal A, said gain controlled signal E and said phase inverted and gain controlled signal H;

Mixing amplifier 35 mixes and amplifies said phase inverted, gain controlled signal F, said gain controlled signal G and said gain controlled signal D.

A listener, hearing the two audio channels, perceives the resulting stereophonic audio output information as being realistic and pleasant in accordance with the purpose of the invention.

The following parameters are mandated for the operation of the apparatus of FIG. 5:

1. Being undelayed, signals A and D must be of least amplitude, in a manner consistant with the principle of the invention.

2. Signal B is least time delayed.

3. Signal C is most time delayed.

4. In applications requiring monaural compatability, amplitude of signal E must equal amplitude of signal F and amplitude of signal G must equal amplitude of signal H thereby establishing two phase inverted paired signals. Summation of the above output stereo signal results in the cancellation of PIPS E,F and G,H, thereby presenting combined residual signals A and B as the output.

5. The inventor has determined that delaying signal B between 0.2 and 60 milliseconds and delaying signal C between 5 and 90 milliseconds produces satisfactory results.

One advantage of this apparatus over that of FIGS. 3 and 4 is in its capability of producing a dramatic perceptual depth dimension. A second advantage is that the undelayed signal remains when summed to mono. In applications such as VCR sound tracks, wherein synchronization between picture and sound is of the essence, this apparatus may prove advantageous.

Details concerning the construction of non-reverberative, linear, high-fidelity, variable, digital time delay circuits 15 and 23, phase inverter 19 and 27 and mixing amplifiers 33 and 35 would be readily apparent to a person skilled in the art.

Figure 6:
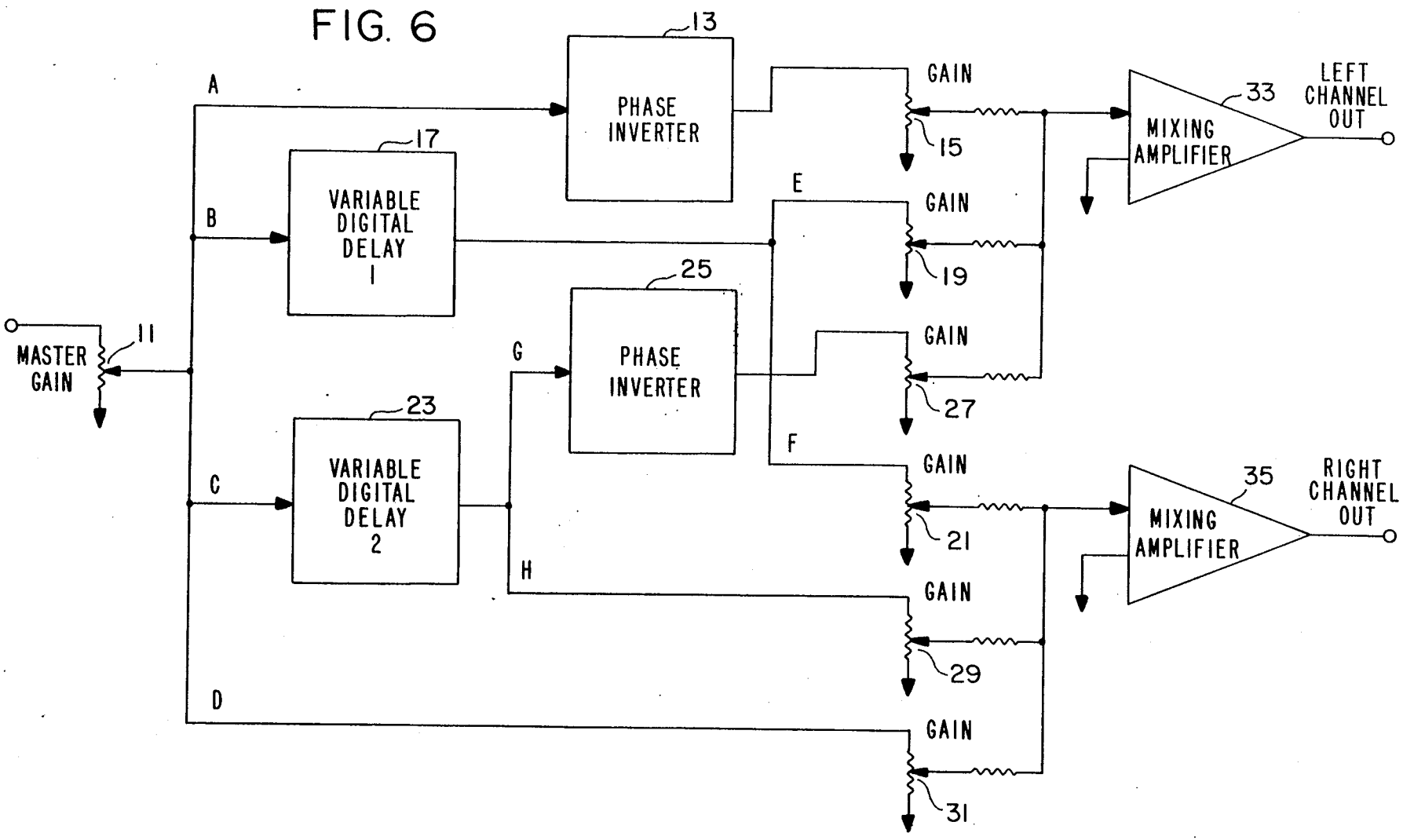

Referring now to the configuration of FIG. 6, the monaural input signal is gain controlled by potentiometer 11 and is divided into four equal signals, A,B,C and D. whereby:

Circuitry 13 and potentiometer 15 impart phase inversion and gain control to signal A;

Circuitry 17 imparts a first variable digital time delay to signal B which is then divided into two equal signals, E and F;

Potentiometer 19 imparts gain control to signal E;

Potentiometer 21 imparts gain control to signal F;

Circuitry 23 imparts a second variable digital time delay to signal C which is then divided into two equal signals, G and H;

Circuitry 25 and potentiometer 27 impart phase inversion and gain control to signal G;

Potentiometer 29 imparts gain control to signal H;

Potentiometer 31 imparts gain control to signal D;

Mixing amplifier 33 mixes and amplifies said phase inverted, gain controlled signal A, said gain controlled signal E and said phase inverted, gain controlled signal G;

Mixing amplifier 35 mixes and amplifies said gain controlled signal F, said gain controlled signal H and said gain controlled signal D.

A listener, hearing the two audio channels, perceives the resulting stereophonic audio output information as being realistic and pleasant in accordance with the purpose of the invention.

Two sets of operating parameters may be employed in the operation of the apparatus of FIG. 6:

Parameter set 1:

1. Being undelayed, signals A and D must be of least amplitude, in a manner consistant with the principle of the invention.

2. Signal B is least time delayed.

3. Signal C is most time delayed.

4. The inventor has determined that delaying signal B between 0.2 and 60 milliseconds and delaying signal A between C and 90 milliseconds produces satisfactory results.

5. In applications requiring monaural compatability, amplitude of signal A is equal to amplitude of signal D and amplitude of signal G is equal to amplitude of signal H. thereby establishing two phase inverted paired signals. Summation of the above output stereo signal results in the cancellation of PIPS A,D and G,H, thereby presenting only combined, least delayed, residual signals E and F as the output.

The principle advantage of the apparatus of FIG. 6, parameter set 1, is that it combines the apparatuses of FIGS. 3 and 4 whereby perceptual width and depth may be independently controlled and whereby the summation of signals E and F results in a large monaural output, thereby providing improved monaural compatability characteristics.

Parameter set 2: is identical to parameter set 1 with the following exceptions:

1. Signal C is least time delayed.

2. Signal B is most time delayed.

3. The inventor has determined that delaying signal C between 0.2 and 60 milliseconds and delaying signal B between 5 and 90 milliseconds produces satisfactory results.

Summation of the above output stereo signal results in the cancellation of PIPS A,D and G,H, thereby presenting only combined most delayed residual signals E and F as the output.

The principle advantage of the apparatus of FIG. 6, parameter set 2 is that it is thought to provide increased width control over set 1. By doing so, some depth control may be lost.

Details concerning the construction of non-reverbative, linear, high-fidelity, variable, digital time delay circuits 17 and 23, phase inverter 13 and 25 and mixing amplifiers 33 and 35 would be readily apparent to a person skilled in the art.

The apparatuses of FIGS. 7 through 10 employ tone control means in conjuction with the means of the invention whereby the output of the configurations of FIGS. 3 through 6 may be fine tuned as to present an optimal stereo-like audio image.

If monaural compatability is of major concern, tone parameters should be selected whereby summation of output stereo channels results in equalization not unlike that of the input signal.

A further refinement in FIGS. 7 to 10 is the employment of a single gain control in conjuction with a single tone control whereby phase inverted paired signals are imparted equal amplitude by a single control, thereby provide excellent monaural compatability characteristics. Said change provides greater simplicity of operation plus diminished cost.

In applications wherein such monaural compatability is not advantageous or required, separate controls may be employed, as in the manner of FIGS. 3 through 6.

Figure 7:
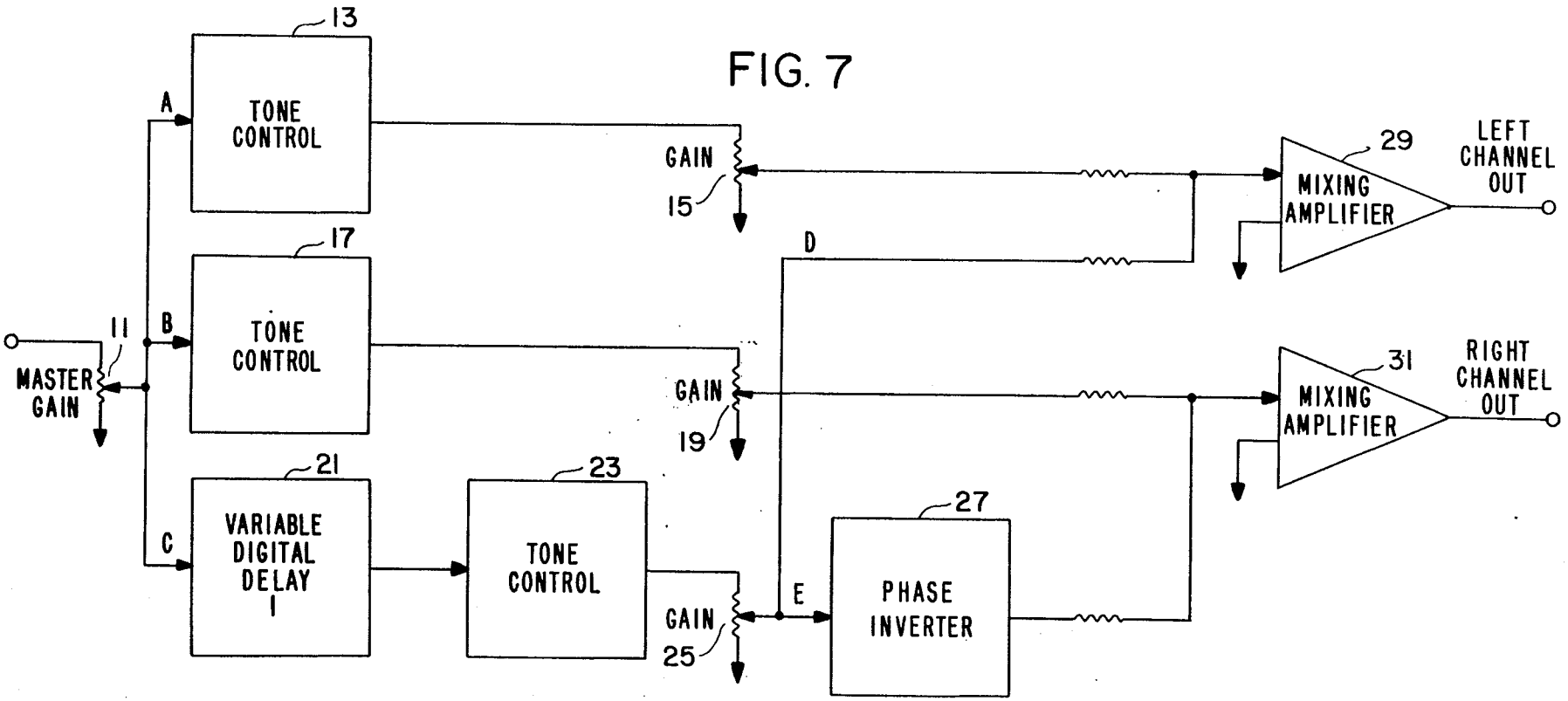

Referring now to the configuration of FIG. 7, the monaural input signal is gain controlled by potentiometer 11 and is divided into three equal signals, A,B and C. whereby:

Circuitry 13 and potentiometer 15 impart tone and gain control to signal A;

Circuitry 17 and potentiometer 19 impart tone and gain control to signal B;

Circuitry 21, circuitry 23 and potentiometer 25 impart variable digital time delay, tone and gain control to signal C which is then divided into two equal signals, D and E;

Circuitry 27 imparts phase inversion to signal E.

Mixing amplifier 29 mixes and amplifies said tone and gain controlled signal A and said signal D;

Mixing amplifier 31 mixes and amplifies said tone and gain controlled signal B and said phase inverted signal E.

A listener, hearing the two audio channels, perceives the resulting stereophonic audio output information as being realistic and pleasant in accordance with the purpose of the invention. The following parameters are mandated for the operation of the apparatus of FIG. 7 whereby:

1. Being undelayed, signals A and B must be of least amplitude in a manner consistant with the principle of the invention.

2. The inventor has determined that delaying signal C between 0.2 and 60 milliseconds produces satisfactory results.

The design of the current apparatus causes the amplitude and frequency content of phase inverted paired signals D and E to be equal. Summation of the above output stereo signal results in the cancellation of PIPS D and E, thereby presenting only combined residual signals A and C as the monaural output.

The tone controls of signals A and B may be utilized independently whereby frequency content may differ in each channel.

Figure 8:
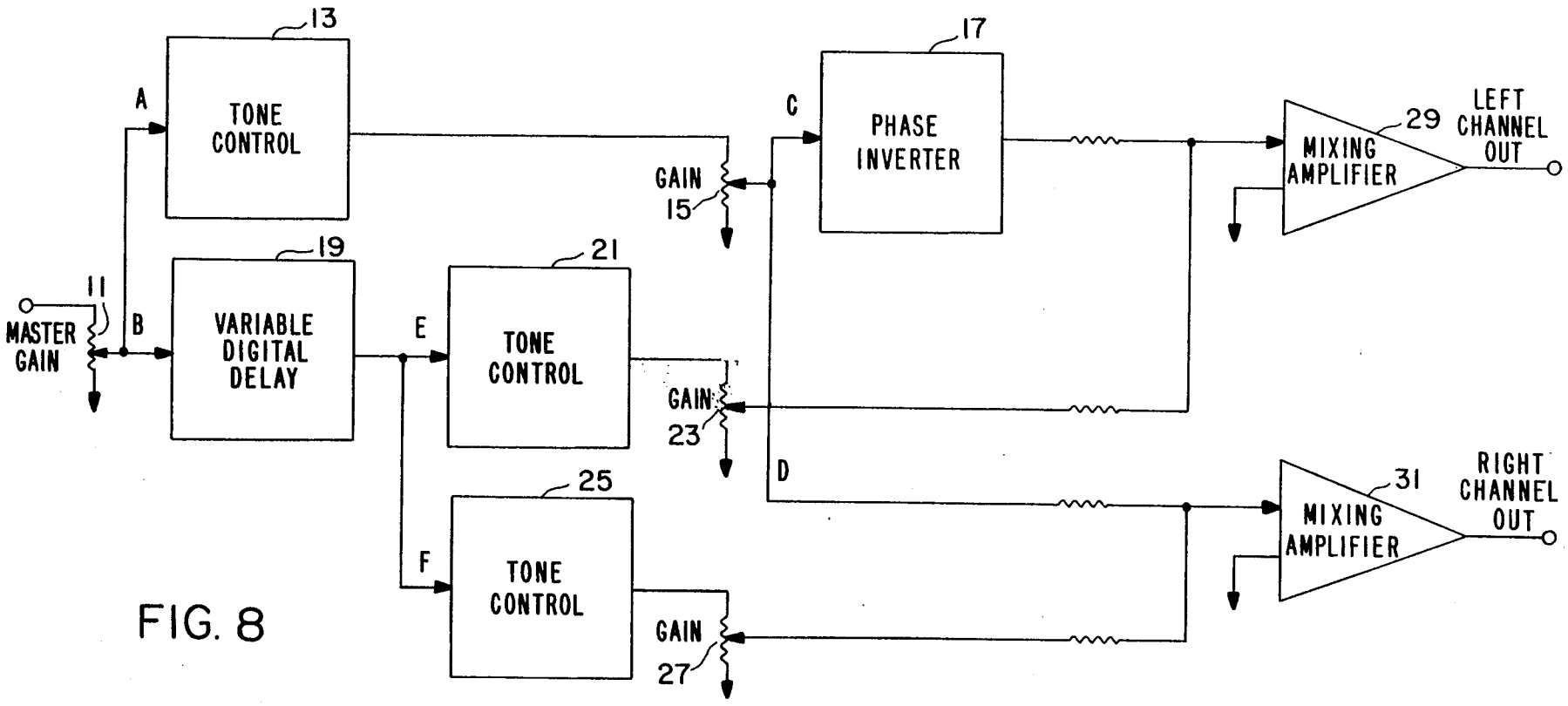

One advantage of this apparatus over that of FIG. 8 is in its capability of producing a perceptual depth dimension. A second advantage is that the undelayed signal remains when summed to mono. In applications such as VCR sound tracks, wherein synchronization between picture and sound is of the essence, this apparatus may prove advantageous.

Details concerning the construction of non-reverberative, linear, high-fidelity, variable, digital time delay circuit 21, phase inverter 27, tone controls 13, 17 and 23, and mixing amplifiers 29 and 31 would be readily apparent to a person skilled in the art.

Referring now to the configuration of FIG. 8, the monaural input signal is gain controlled by potentiometer 11 and is divided into two equal signals, A and B. whereby:

Circuitry 13 and potentiometer 15 impart tone and gain control to signal A which is then divided equally into two equal signals, C and D;

Circuitry 17 imparts phase inversion to signal C;

Circuitry 19 imparts variable digital time delay to signal B which is then divided into two equal signals E and F;

Circuitry 21 and potentiometer 23 impart tone and gain control to signal E;

Circuitry 25 and gain control 27 impart tone and gain control to signal F;

Mixing amplifier 29 mixes and amplifies said phase inverted signal C and said tone and gain controlled signal E;

Mixing amplifier 31 mixes and amplifies said signal D and tone and gain controlled signal F.

A listener, hearing the two audio channels, perceives the resulting stereophonic audio output information as being realistic and pleasant in accordance with the purpose of the invention.

The following parameters are mandated for the operation of the apparatus of FIG. 8:

1. Being undelayed, signals C and D of least amplitude, in a manner consistant with the principle of the invention.

2. The inventor has determined that delaying signal C between 0.2 and 60 milliseconds produces satisfactory results.

The design of the current apparatus causes the amplitude and frequency content of phase inverted paired signals C and D to be equal. Summation of the above output stereo signal results in the cancellation of PIPS C and D, thereby presenting combined residual signals E and F as the monaural output.

The tone controls of signals E and F may be utilized independently whereby frequency content may differ in each output channel.

One advantage of this apparatus over that of FIG. 7 is in its capability of producing a perceptual width dimension.

A second advantage of this apparatus over that of FIG. 7 is in its production of a large monaural signal during summation of output channels, thereby producing improved monaural compatability characteristics. (According to the principle of the invention, delayed signals E and F are ALWAYS of greater amplitude than undelayed signals C and D.)

Details concerning the construction of non-reverberative, linear, high-fidelity, variable, digital time delay circuit 19, phase inverter 17, tone controls 13, 21 and 25, and mixing amplifiers 29 and 31 would be readily apparent to a person skilled in the art.

Figure 9:
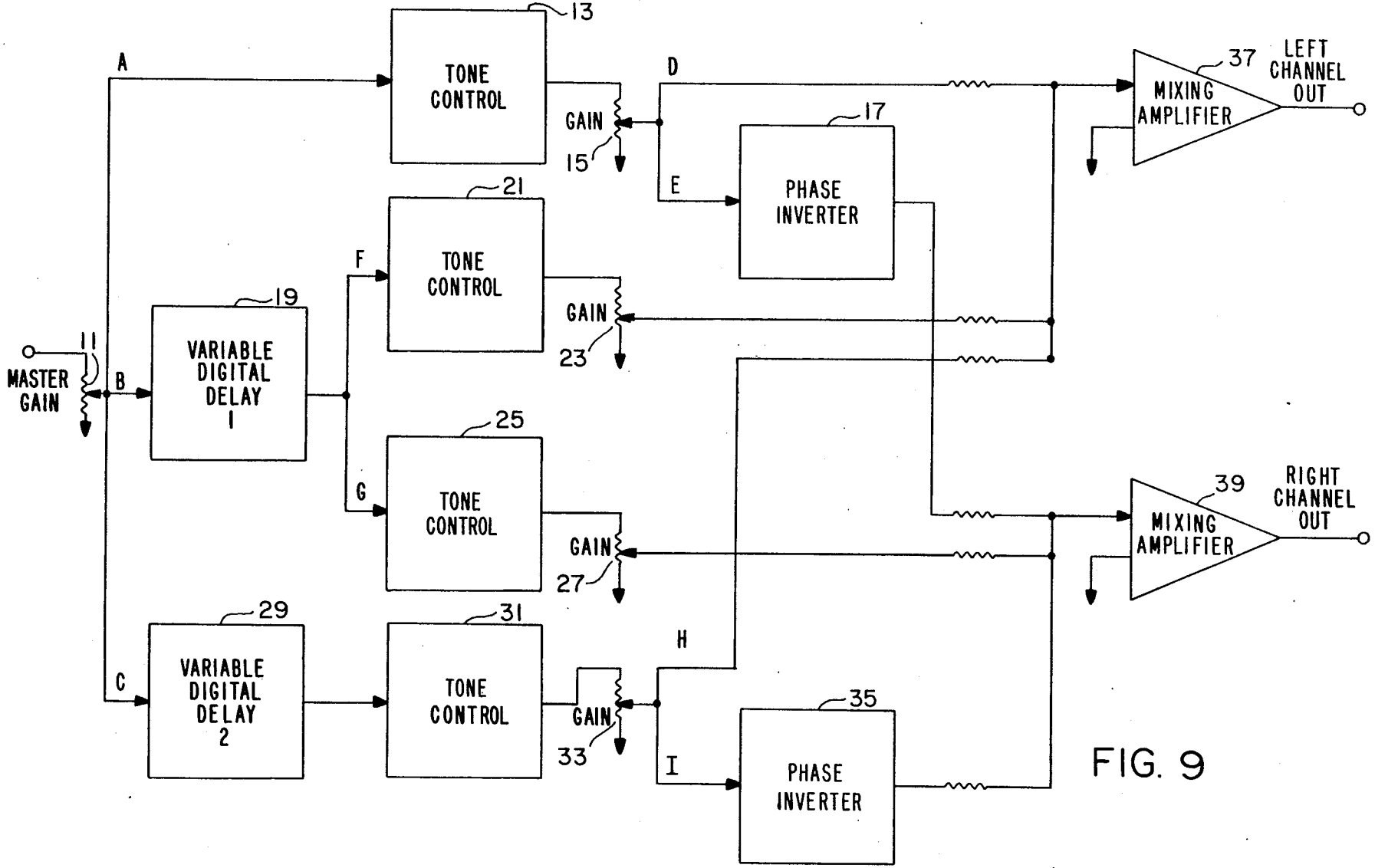

Referring now to the configuration of FIG. 9, the monaural input signal is gain controlled by potentiometer 11 and is divided into three equal signals, A, B and C. whereby:

Circuitry 13 and potentiometer 15 impart tone and gain control to signal A which is then divided into two equal signals, D and E;

Circuitry 17 imparts phase inversion to signal E;

Circuitry 19 imparts a first variable digital time delay to signal B which is then divided into two equal signals, F and G;

Circuitry 21 and potentiometer 23 impart tone and gain control to signal F;

Circuitry 25 and potentiometer 27 impart tone and gain control to signal G;

Circuitry 29, circuitry 31 and potentiometer 33 impart a second variable digital time delay, tone and gain control to signal C which is then divided into two equal signals H and I;

Circuitry 35 imparts phase inversion to signal I;

Mixing amplifier 37 mixes and amplifies said signal D, said tone and gain controlled signal F and said signal H;

Mixing amplifier 39 mixes and amplifies said phase inverted signal E, said tone and gain controlled signal G and said phase inverted signal I.

A listener, hearing the two audio channels, perceives the resulting stereophonic audio output information as being realistic and pleasant in accordance with the purpose of the invention.

Two sets of operating parameters may be employed in the operation of the apparatus of FIG. 9:

Parameter set 1:

1. Being undelayed, signals D and E must be of least amplitude, in a manner consistant with the principle of the invention.
2. Signal B is least time delayed.
3. Signal C is most time delayed.
4. The inventor has determined that delaying signal B between 0.2 and 60 milliseconds and delaying signal C between 5 and 90 milliseconds produces satisfactory results.

The design of the current apparatus provides phase inverted paired signals D,E and H,I. Summation of the above output stereo signal results in the cancellation of PIPS D,E and H,I, thereby presenting only combined least delayed residual signals F and G as the output.

The tone controls of signals F and G may be utilized independently whereby frequency content may differ in each output channel.

The principle advantage of the apparatus of FIG. 9, parameter set 1, is that it combines the apparatuses of FIGS. 7 and 8 whereby perceptual width and depth may be independently controlled and whereby the summation of signals F and G results in a large output, thereby providing excellent monaural compatability characteristics.

Parameter set 2: is identical to parameter set 1 with the following exceptions:

1. Signal C is least time delayed.
2. Signal B is most time delayed.
3. The inventor has determined that delaying signal C between 0.2 and 60 milliseconds and delaying signal B between 5 and 90 milliseconds produces satisfactory results.

Summation of the above output stereo signal results in the cancellation of PIPS D, E and H, I, thereby presenting only combined most delayed residual signals F and G as the output.

The principle advantage of the apparatus of FIG. 9, parameter set 2 is that it provides increased width control over set 1. By doing so, some depth control may be lost.

Details concerning the construction of non-reverberative, linear, high-fidelity, variable, digital time delay circuits 19 and 29, phase inverter circuits 17 and 35, tone control circuits 13, 21, 25 and 31, and mixing amplifiers 37 and 39 would be readily apparent to a person skilled in the art.

Figure 10:
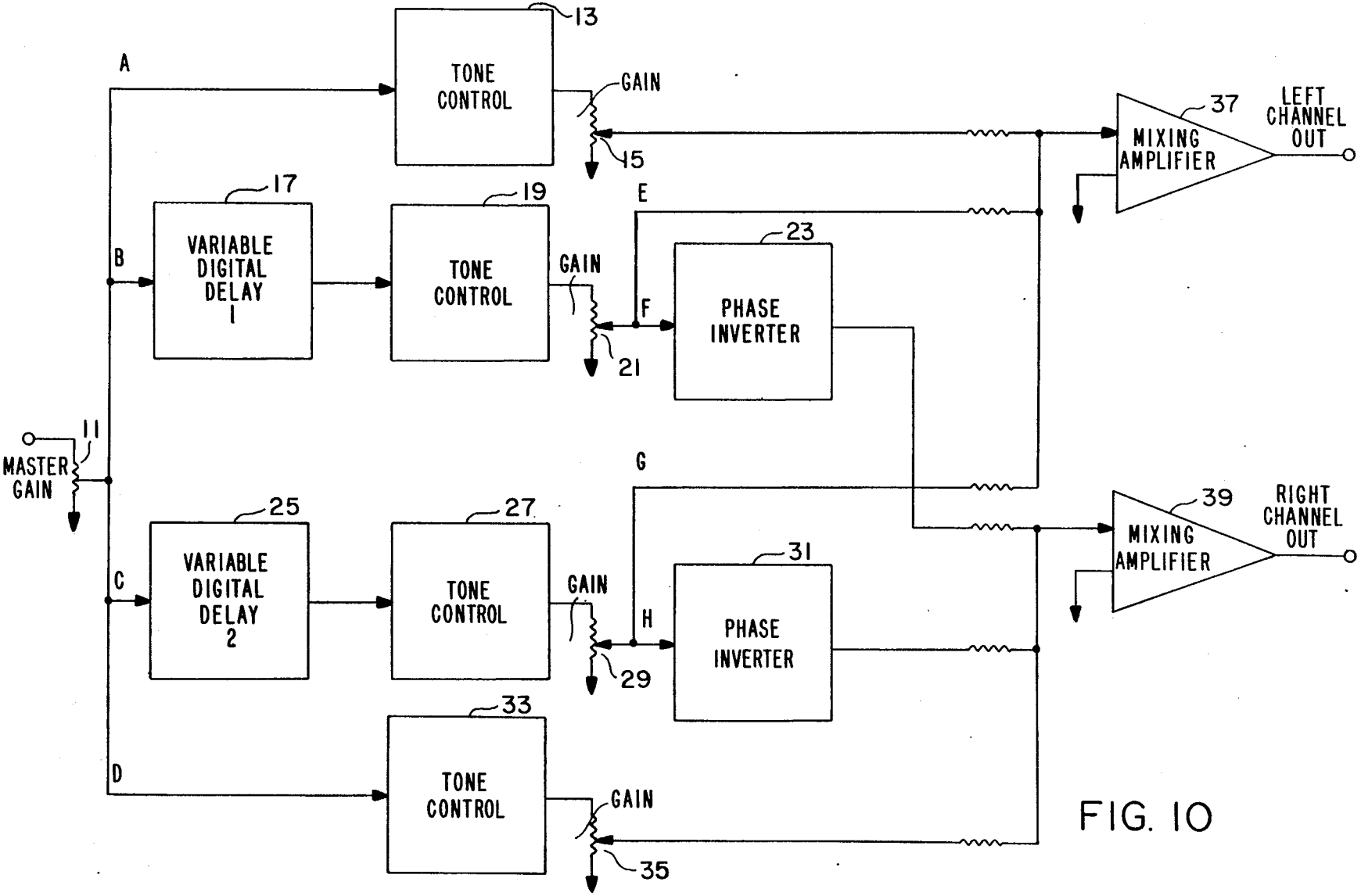

Referring now to the configuration of FIG. 10, the monaural input signal is gain controlled by potentiometer 11 and is divided into four equal signals, A,B,C and D. whereby:

Circuitry 13 and potentiometer 15 impart tone and gain control to signal A;

Circuitry 17, circuitry 19 and gain control means 21 impart a first variable digital time delay, tone and gain control to signal B which is then divided into two equal signals, E and F;

Circuitry 23 imparts phase inversion to signal F;

Circuitry 25, circuitry 27 and potentiometer 29 impart a second variable digital time delay, tone and gain control to signal C which is then divided into two equal signals, G and H;

Circuitry 31 imparts phase inversion to signal H;

Circuitry 33 and potentiometer 35 impart tone and gain control to signal D;

Mixing amplifier 33 mixes and amplifies said tone and gain controlled signal A, said signal E and said signal G;

Mixing amplifier 39 mixes and amplifies said phase inverted signal F, said phase inverted signal H and said tone and gain controlled signal D.

A listener, hearing the two audio channels, perceives the resulting stereophonic audio output information as being realistic and pleasant in accordance with the purpose of the invention.

The following parameters are mandated for the operation of the apparatus of FIG. 10:

1. Being undelayed, signals A and D must be of least amplitude, in a manner consistant with the principle of the invention.
2. Signal B is least time delayed.
3. Signal C is most time delayed.
4. The inventor has determined that delaying signal B between 0.2 and 60 milliseconds and delaying signal C between 5 and 90 milliseconds produces satisfactory results.

The design of the current apparatus provides phase inverted paired signals E,F and G,H. Summation of the above output stereo signal results in the cancellation of PIPS E,F and G,H thereby presenting only combined undelayed residual signals A and D as the output.

The tone controls of signals A and D may be utilized independently whereby frequency content may differ considerably in each output channel. One advantage of this apparatus over that of FIG. 8 is in its capability of producing a perceptual depth dimension. A second advantage is that the undelayed signal remains when summed to mono. In applications such as VCR sound tracks, wherein synchronization between picture and sound is of the essence, this apparatus may prove advantageous.

Details concerning the construction of non-reverberative, linear, high-fidelity, variable, digital time delay circuits 17 and 25, phase inverter circuits 23 and 31, tone control circuits 13, 19, 27 and 33, and mixing amplifiers 37 and 39 would be readily apparent to a person skilled in the art.

Figure 11:
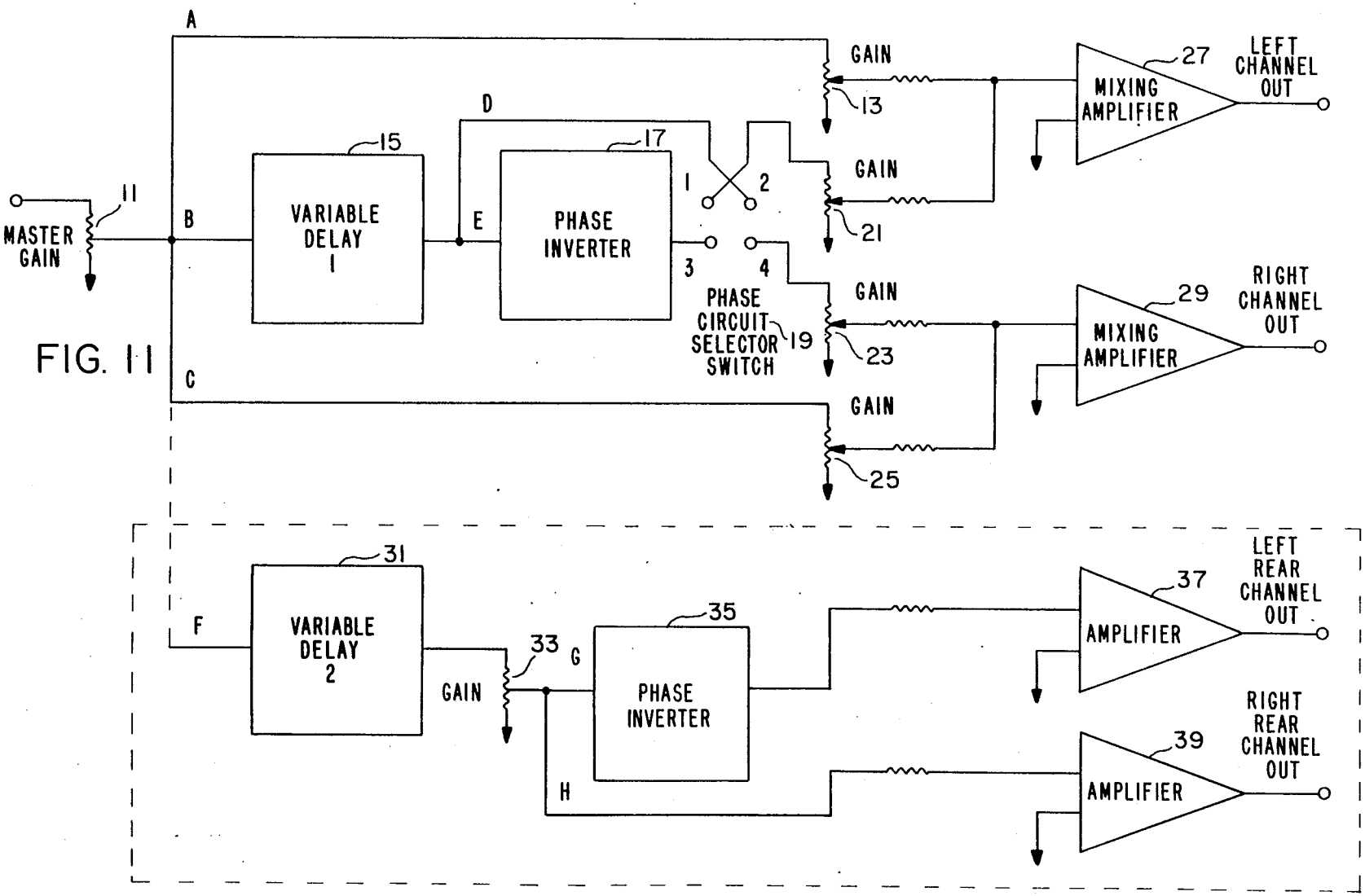
FIG. 11 is a block diagram of an embodiment of the invention which utilizes two time delay means, two phase inversion means, five gain control means and one phase circuit selector switch in the production of a four channel audio output from a single channel audio input.

FIG. 11 modifies the apparatus of FIG. 3 by the addition of a phase inversion selector switch means and a monaurally compatable quadraphonic or surround sound means. Both circuits may be applied to any of the configurations of FIGS. 3 through 10.

Referring now to the configuration of FIG. 11, the monaural input signal is gain controlled by potentiometer 11 and is divided into four equal signals, A, B, C and F. whereby:

Potentiometer 13 imparts gain control to signal A;

Circuitry 15 imparts a first variable digital time delay to signal B which is then divided into two equal signals D and E;

Circuitry 17 imparts phase inversion to signal E;

Potentiometer 25 imparts gain control to signal C;

If circuitry 19 is configured whereby contact points 1 and 2 are shunted and contact points 3 and 4 are shunted (contingency #1):

Potentiometer 21 imparts gain control to signal D;

Potentiometer 23 imparts gain control to signal E;

If circuitry 19 is configured whereby contact points 1 and 3 are shunted and contact points 2 and 4 are shunted (contingency #2):

Potentiometer 21 imparts gain control to signal E;

Potentiometer 23 imparts gain control to signal D;

Circuitry 31 and potentiometer 33 impart a second variable digital time delay and gain control to signal F which is then divided into two equal signals G and H;

Circuitry 35 imparts phase inversion to signal G;

In contingency situation #1 above, mixing amplifier 27 mixes and amplifies said gain controlled signal A and said gain controlled signal D to produce the output of the first of four channels;

Mixing amplifier 29 mixes and amplifies said phase inverted and gain controlled signal E and said gain controlled signal C to produce the output of the second of four channels;

Amplifier 37 amplifies said phase inverted signal G to produce the output of the third of four channels;

Amplifier 39 amplifies said signal H to produce the output of the foruth of four channels.

In contingency situation #2 above, mixing amplifier 27 mixes and amplifies said gain controlled signal A and said phase inverted and gain controlled signal E to produce the output of the first of four channels;

Mixing amplifier 29 mixes and amplifies said gain controlled signal D and said gain controlled signal C to produce the output of the second of four channels;

Amplifier 37 amplifies said phase inverted signal G to produce the output of the third of four channels;

Amplifier 39 amplifies said signal H to produce the output of the fourth of four channels.

In a manner well known in the presentation of quadraphonic sound, the output of the first and second channels is presented before and to either side of the listener; the output of the third and fourth channels is presented behind and to either side of the listener.

A listener, hearing the four audio channels, perceives the resulting stereophonic audio output information as being realistic and pleasant in accordance with the purpose of the invention.

The phase inversion selector switch provides means of placement of give phase inversion means in either of two channels. While not of great benefit in the balanced configuration of FIG. 3, the employment of said switch in FIGS. 5, 6, 9 and 10 would provide either one or two phase inversion circuits in the output of a given channel, thereby modifying the sonic effect attained.

The configuration of FIG. 11 employs the apparatus of FIG. 3 in conjunction with a modification of the apparatus of FIG. 2 whereby a monaurally compatable quadraphonic or surround sound output may be produced.

The following parameters are mandated for the operation of the apparatus of FIG. 11:

1. Being undelayed, signals A and C must be of least amplitude, in a manner consistant with the principle of the invention.

2. The delay value of signal F is greater than that of signal B.

3. In applications requiring monaural compatability, amplitude of signal D must equal to signal E, and signal G must equal signal H, thereby establishing two phase inverted paired signals. Summation of the above output stereo signals results in the cancellation of PIPS signals D and E and PIPS signals G and H, thereby presenting only combined residual signals A and C as the monaural output.

The inventor has determined that delaying signal B between 0.2 and 60 milliseconds and delaying signal F between 5 and 30 milliseconds greater than signal B produces satisfactory results.

Playback on the configuration of FIG. 11 provides a rich, multi-dimensional surround-sound feel wherein the listener's enjoyment and the perception of reality are greatly enhanced.

Details concerning the construction of non-reverberative, linear, high-fidelity, variable, digital time delay circuits 15 and 31, phase inverter circuits 17 and 35, phase circuit selector switch 19, mixing amplifiers 27 and 29 and amplifiers 37 and 39 would be readily apparent to a person skilled in the art.

Adaptation of phase circuit selector switch of FIG. 11 to FIGS. 5, 6, 9 and 10 would be readily apparent to a person skilled in the art.

Adaptation of circuit F of FIG. 11 to other configurations of the invention for quadraphonic or surround sound applications would be readily apparent to a person skilled in the art.

Above time delay parameters apply for "normal" signal processing applications. Time parameters may be increased as user desires for "adnormal" special effects applications.

Figure 12:
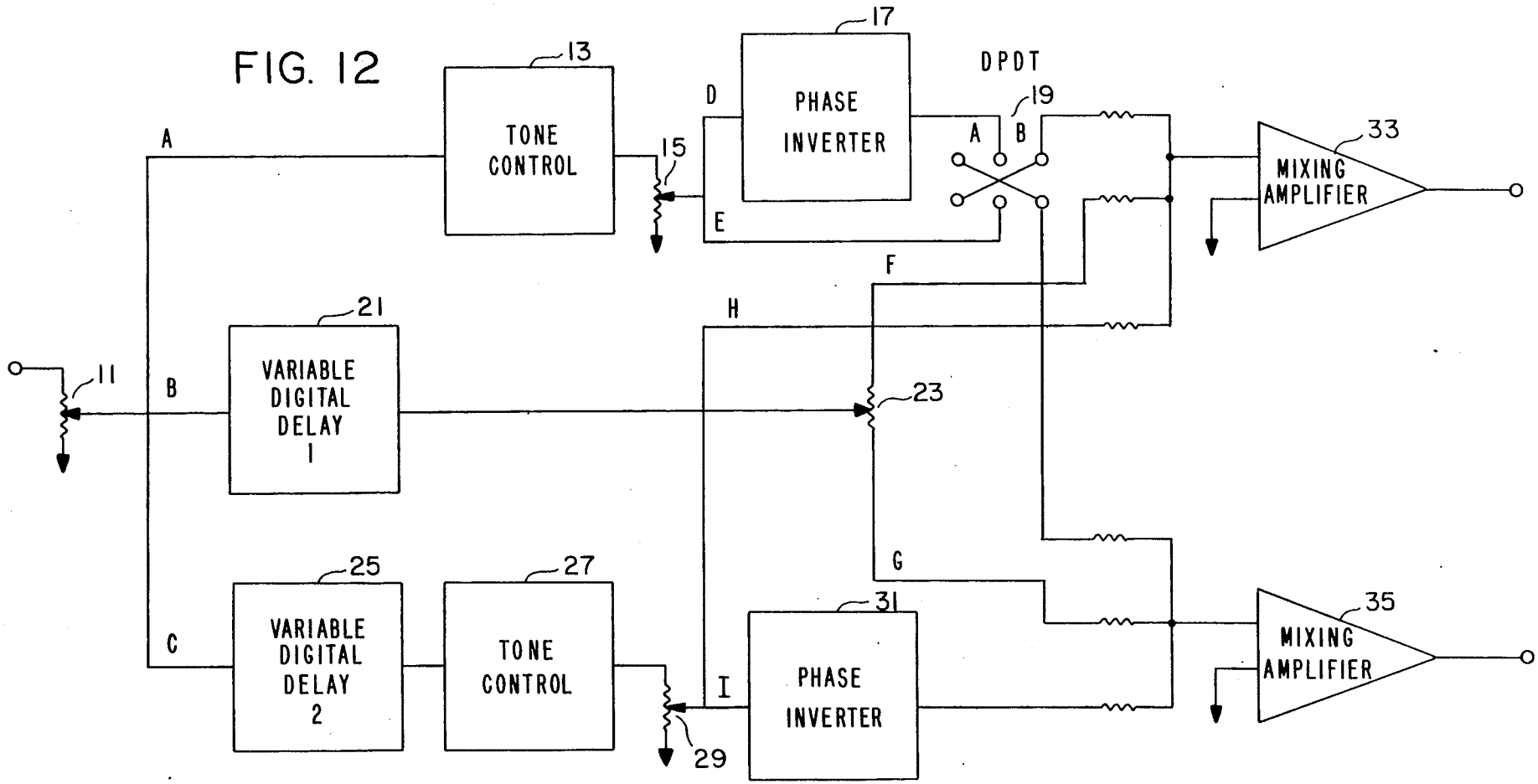
FIG. 12 is a block diagram of an embodiment of the invention which utilizes two time delay means, two phase inversion means, two tone control means, two gain control means, two ratio control means and one phase circuit selector switch in the production of a two channel audio output from a single channel audio input.

Referring now to the configuration of FIG. 12, the monaural input signal is gain controlled by potentiometer 11 and is divided into three equal signals, A, B and C whereby:

Circuitry 13 and potentiometer 15 impart tone control and gain control to signal A which is then divided into signals D and E.

Circuitry 17 imparts phase inversion to signal D.

Circuitry 21 imparts a first variable digital time delay to signal B which is then divided via potentiometer 23 into two signals F and G.

Circuitry 25, circuitry 27 and potentiometer 29 impart a second variable digital time delay, tone control and gain control to signal C which is then divided into two equal signals H and I.

Circuitry 31 imparts phase inversion to signal I.

If switch 19 is in position A:

Mixing amplifier 33 mixes and amplifies said signal E, said signal F and said signal H;

Mixing amplifier 35 mixes and amplifies said phase inverted signal D, said signal G and said phase inverted signal I.

If switch 19 is in position B:

Mixing amplifier 33 mixes and amplifies said phase inverted signal D, said signal F and said signal H;

Mixing amplifier 35 mixes and amplifies said signal E, said signal G and said phase inverted signal I.

A listener, hearing the two audio channels, perceives the resulting stereophonic audio output information as being realistic and pleasant in accordance with the purpose of the invention.

Two sets of operating parameters may be employed in the operation of the apparatus of FIG. 12:

Parameter set 1:

1. Being undelayed, signal A must be of least amplitude, in a manner consistent with the principle of the invention.

2. Signal B is least time delayed.

3. Signal C is most time delayed.

4. The inventor has determined that delaying signal B between 0.2 and 60 milliseconds and delaying signal C between 5 and 90 milliseconds produces satisfactory results.

The design of the current apparatus provides phase inverted paired signals D, E and H, I. Summation of the above output stereo as in mono compatibility contingency situations results in the cancellation of PIPS D, E and H, I, thereby presenting only combined least delayed residual signals F and G as the output.

Potentiometer 15 and potentiometer 29 may be ganged in an inverse relationship whereby width and depth parameters may be simultaneously controlled providing increased ease of operation over the prior configurations.

Potentiometer 23 is a balance control which distributes delayed signal B to left and right stereo channels. Additional phase inversion circuitry may be required to assure resultant signals F and G remain in phase with one another.

Parameter set 2: is identical to parameter set 1 with the following exceptions:

1. Signal C is least time delayed.

2. Signal B is most time delayed.

3. The inventor has determined that delaying signal C between 0.2 and 60 milliseconds and delaying signal B between 5 and 90 milliseconds produces satisfactory results.

Summation of the above output stereo signal again results in the cancellation of PIPS D, E and H, I, thereby presenting only combined most delayed residual signals F and G as the output.

The principle advantage of the apparatus of figure 12, parameter set 2 is that it provides increased width control over set 1. By doing so, some depth control may be lost.

Details concerning the construction of non-reverberative, linear, high-fidelity, variable, digital time delay circuits 21 and 25, phase inverter circuits 17 and 31, tone control circuits 13 and 27 and mixing amplifiers 33 and 35 would be readily apparent to a person skilled in the art.

Adding tone controls to the circuitry of signals F and G of FIG. 12 in the manner of signals F and G of FIG. 9 would be readily apparent to a person skilled in the art.

We claim:

1. Apparatus for producing a two channel simulated stereophonic output from a monaural input which has initially been divided into three equal signals; A, B and C, comprising:

a) means for providing tone control of signal A;

b) means for providing gain control of tone controlled signal A;

c) means for dividing gain controlled signal A into signals D and E.

d) means for inverting signal D 180 degrees with respect to signal E;

e) means for switching signals D and E to opposing output channels;

f) means for imparting time delay to signal B;

g) means for providing gain controlled balance of time delayed signal B to provide signals F and G.

h) means for imparting time delay to signal C;

i) means for providing tone control of time delayed signal C;

j) means for providing gain control of tone controlled signal C;

k) means for dividing gain controlled signal C into equal signals, H and I;

l) means for inverting signal I 180 degrees with respect to signal H;

m) means for mixing said signal E, said signal F and said signal H to produce first one of said simulated stereophonic channel outputs and;

n) means for mixing said phase inverted signal D, said signal G and said phase inverted signal I to produce second one of said simulated stereophonic channel outputs;

o) or, in accordance with e above, means for mixing said phase inverted signal D, said signal F and said signal H to produce first one of said simulated stereophonic channel outputs and;

p) means for mixing said signal E, said signal G and said phase inverted signal I to produce second one of said simulated stereophonic channel outputs;

wherein said tone and gain controlled signals D and E are the signals of least amplitude and wherein said time delayed signal B is imparted with less delay value than is said time delayed signal C and;

whereby the relationship of time, gain and phase imparts simulated stereophonic output, with little, if any, addition to reverberative content of the monaural input.

2. Apparatus for producing simulated stereophonic two channel output from a single channel monaural input which has been divided into three substantially equal monaural signals comprising:

first time delay means for imparting a first time delay to a first one of said three monaural signals;

second time delay means for imparting a second time delay to a second one of said three monaural signals;

first gain control means coupled to said first time delay means, for providing gain control to said first time delayed monaural signal;

first phase inverter means coupled to said first time delay means for inverting said first time delayed monaural signal;

second phase inverter means coupled to said second time delay means for inverting said second time delayed monaural signal;

second gain control means coupled to said second phase inverter means for providing gain control to said second phase inverted, time delayed monaural signal;

third gain control means for providing gain control to a third one of said three monaural signals;

fourth gain control means for providing a second gain control to said third monaural signal;

fifth gain control means coupled to said first phase inverter means for providing gain control to said first phase inverted, time delayed monaural signal;

sixth gain control means coupled to said second time delay means for providing gain control to said second time delayed monaural signal;

first mixer means coupled to said first, second and third gain control means for mixing said first, second and third gain controlled signals to provide a first channel output signal;

second mixer means coupled to said fourth, fifth and sixth gain control means for mixing said fourth, fifth and sixth gain controlled signals to provide a second channel output signal;

whereby said first and second channel output signals result in the production of a simulated stereophonic two channel output.

3. Apparatus for producing simulated stereophonic two channel output from a single channel monaural input which has been divided into three substantially equal monaural signals comprising:

time delay means for imparting a time delay to a first one of said three monaural signals;

phase inverter means coupled to said time delay means for inverting said time delayed monaural signal;

first gain control means coupled to said phase inverter means, for providing gain control to said time delayed, phase inverted monaural signal;

second gain control means for providing gain control to a second one of said three monaural signals;

third gain control means for providing gain control to a third one of said three monaural signals;

fourth gain control means for providing gain control to said time delayed monaural signal;

first mixer means coupled to said first and second gain control means for mixing said first and second gain controlled signals to provide a first channel output signal;

second mixer means coupled to said third and fourth gain control means for mixing said third and fourth gain controlled signals to provide a second channel output signal;

whereby said first and second channel output signals result in the production of a simulated stereophonic two channel output.

4. Apparatus for producing simulated stereophonic two channel output from a single channel monaural input which has been divided into three substantially equal monaural signals comprising:

time delay means for imparting a time delay to a first one of said three monaural signals;

First gain control means coupled to said time delay means, for providing a first gain control to said time delayed monaural signal;

phase inverter means for inverting a second one of said three monaural signals;

second gain control means coupled to said phase inverter means for providing gain control to said phase inverted monaural signal;

third gain control means coupled to said time delay means for providing a second gain control to said time delayed monaural signal;

fourth gain control means for providing gain control to a third one of said three monaural signals;

first mixer means coupled to said first and second gain control means for mixing said first and second gain controlled signals to provide a first channel output signal;

second mixer means coupled to said third and fourth gain control means for mixing said third and fourth gain controlled signals to provide a second channel output signal;

whereby said first and second channel output signals result in the production of a simulated stereophonic two channel output.

5. A method for producing simulated stereophonic two channel output from a single channel monaural input which has been divided into three substantially equal monaural signals comprising the steps of:

imparting a first time delay to a first one of said three monaural signals;

imparting a second time delay to a second one of said three monaural signals;

providing first gain control to said first time delayed monaural signal;

inverting said first time delayed monaural signal;

inverting said second time delayed monaural signal;

providing second gain control to said second phase inverted, time delayed monaural signal;

providing third gain control to a third one of said three monaural signals;

providing fourth gain control to said third monaural signal;

providing fifth gain control to said first phase inverted, time delayed monaural signal;

providing sixth gain control to said second time delayed monaural signal;

mixing said first, second and third gain controlled signals to provide a first channel output signal;

mixing said fourth, fifth and sixth gain controlled signals to provide a second channel output signal;

whereby said first and second channel output signals result in the production of a simulated stereophonic two channel output.

6. A method for producing simulated stereophonic two channel output from a single channel monaural input which has been divided into three substantially equal monaural signals comprising the steps of:

imparting a time delay to a first one of said three monaural signals;

inverting said time delayed monaural signal;

providing first gain control to said time delayed, phase inverted monaural signal;

providing second gain control to a second one of said three monaural signals;

providing third gain control to a third one of said three monaural signals;

providing fourth gain control to said time delayed monaural signal;

mixing said first and second gain controlled signals to provide a first channel output signal;

mixing said third and fourth gain controlled signals to provide a second channel output signal;

whereby said first and second channel output signals result in the production of a simulated stereophonic two channel output.

7. A method for producing simulated stereophonic two channel output from a single channel monaural input which has been divided into three substantially equal monaural signals comprising the steps of:

imparting a time delay to a first one of said three monaural signals;

providing first gain control to said time delayed monaural signal;

inverting a second one of said three monaural signals;

providing second gain control to said phase inverted monaural signals;

providing third gain control to said time delayed monaural signal;

providing fourth gain control to a third one of said three monaural signals;

mixing said first and second gain controlled signals to provide a first channel output signal;

mixing said third and fourth gain controlled signals to provide a second channel output signal;

whereby said first and second channel output signals result in the production of a simulated stereophonic two channel output.

8. Apparatus for producing simulated stereo two channel output from a single channel monaural input which has been divided into four substantially equal monaural signals comprising:

first phase inverter means for imparting phase inversion to a first of four monaural signals;

first time delay means for imparting a first time delay to a second one of four monaural signals;

second time delay means for imparting a second time delay to a third of four said monaural signals;

second phase inverter means coupled to said second time delay means for inverting said delayed third monaural signal;

first gain control means coupled to said first phase inverter means, for providing gain control to said phase inverted first monaural signal;

second gain control means coupled to said first time delay means for providing gain control to said time delayed second monaural signal;

third gain control means coupled to said second phase inverter means for providing gain control to said time delayed, phase inverted, third monaural signal;

fourth gain control means coupled to said first time delay means for providing gain control to said time delayed second monaural signal;

fifth gain control means coupled to said second time delay means for providing gain control to said time delayed third monaural signal;

sixth gain control means for providing gain control to said fourth monaural signal;

first mixer means coupled to said first, second and third gain control means for mixing said first, second and third gain controlled signals to provide a first channel output signal;

second mixer means coupled to said fourth, fifth and sixth gain control means for mixing said fourth, fifth and sixth gain controlled signals to provide a second channel output signal, whereby said first and second channel output signals result in the production of a simulated stereophonic two channel output.

9. Apparatus for producing a two channel simulated stereophonic output from a monaural input which has initially been divided into three equal signals; A, B, and C, comprising:

a) means for imparting time delay to signal A;

b) means for providing gain control to time delayed signal A;

c) means for providing gain control to signal B;

d) means for imparting time delay to signal C;

e) means for providing gain control of time delayed signal C;

f) means for mixing said time delayed, gain controlled signal A and gain controlled signal B to produce first one of said simulated stereophonic channel outputs and;

g) means for providing said time delayed, gain controlled signal C to produce second one of said simulated stereophonic channel outputs;

wherein said gain controlled signal B is signal of least amplitude and wherein said time delayed, gain controlled signal A is imparted with greater delay value than is said time delayed, gain controlled signal C and;

whereby the relationship of time and gain imparts a simulated stereophonic output which contains little, if any, additional reverberation as compared to said monaural input signal;

wherein said single channel monaural input has been further divided as to provide a fourth monaural signal, D, which is equal to said signals A, B and C, said apparatus further comprising:

a) means for imparting time delay to signal D;

b) means for dividing time delayed signal D into equal signals, E and F;

c) means for providing gain control of signal E as a third channel output signal and;

d) means for providing gain control of signal F as a fourth channel output signal.

10. Apparatus for producing a two channel simulated stereophonic output from a monaural input which has initially been divided into four equal signals; A, B, C and D, comprising:

a) means for providing gain control of signal A;

b) means for imparting time delay to signal B;

c) means for dividing delayed signal B into equal signals, E and F;

d) means for providing gain control of signal E;

e) means for inverting signal F 180 degrees with respect to signal E;

f) means for providing gain control or inverted signal F;

g) means for imparting time delay to signal C;

h) means for dividing delayed signal C into equal signals, G and H;

i) means for providing gain control of signal G;

j) means for inverting signal H 180 degrees with respect to signal G;

k) means for providing gain control of inverted signal H;

l) means for providing gain control of signal D;

m) means for mixing said gain controlled signal A, said gain controlled signal E and said phase inverted, gain controlled signal H to produce first one of said simulated stereophonic channel outputs and;

n) means for mixing said phase inverted, gain controlled signal F, said gain controlled signal G and said gain controlled signal D to produce second one of said simulated stereophonic channel outputs.

wherein said time delayed signal B is imparted with less delay value than is said time delayed signal C and;

whereby the relationship of time, gain and phase imparts a simulated stereophonic output which contains little, if any, additional reverberation as compared to the monaural input signal.

11. Apparatus for producing a two channel simulated stereophonic output from a monaural input which has initially been divided into three equal signals; A, B, and C, comprising:

a) means for providing gain control of signal A;

b) means for imparting time delay to signal B;

c) means for dividing delayed signal B into equal signals, D and E;
d) means for providing gain control of signal D;
e) means for inverting signal E 180 degrees with respect to signal D;
f) means for providing gain control of inverted signal E;
g) means for providing gain control of signal C;
h) means for mixing said gain controlled signal A and said gain controlled signal D to produce first one of said simulated stereophonic channel outputs and;
i) means for mixing said phase inverted, gain controlled signal E and said gain controlled signal C to produce second one of said simulated stereophonic channel outputs.

whereby the relationship of time, gain and phase imparts a simulated stereophonic output which contains little, if any, additional reverberation as compared to the monaural input signal.

12. Apparatus for producing a two channel simulated stereophonic output from a monaural input which has initially been divided into three equal signals; A, B, and C, comprising:

a) means for inverting signal A 180 degrees with respect to signal C;
b) means for providing gain control of inverted signal A;
c) means for imparting time delay to signal B;
d) means for dividing delayed signal B into equal signals, D and E;
e) means for providing gain control of signal D;
f) means for providing gain control of signal E;
g) means for providing gain control of signal C;
h) means for mixing said phase inverted, gain controlled signal A and said gain controlled signal D to produce first one of said simulated stereophonic channel outputs and;
i) means for mixing said gain controlled signal E and said gain controlled signal C to produce second one of said simulated stereophonic channel outputs.

whereby the relationship of time, gain and phase imparts a simulated stereophonic output which contains little, if any, additional reverberation as compared to the monaural input signal.

13. Apparatus for producing a two channel simulated stereophonic output from a monaural input which has initially been divided into four equal signals; A, B, C and D, comprising:

a) means for inverting signal A 180 degrees with respect to signal D;
b) means for providing gain control of inverted signal A;
c) means for imparting time delay to signal B;
d) means for dividing delayed signal B into equal signals, E and F;
e) means for providing gain control of signal E;
f) means for providing gain control of signal F;
g) means for imparting time delay to signal C;
h) means for dividing delayed signal C into equal signals, G and H;
i) means for inverting signal G 180 degrees with respect to signal H;
j) means for providing gain control of inverted signal G;
k) means for providing gain control of signal H;
l) means for providing gain control of signal D;
m) means for mixing said phase inverted, gain controlled signal A, said gain controlled signal E and said phase inverted, gain controlled signal G to produce first one of said simulated stereophonic channel outputs and;
n) means for mixing said gain controlled signal F, said gain controlled signal H and said gain controlled signal D to produce second one of said simulated stereophonic channel outputs.

wherein said time delayed signal B is imparted with less delay value than is said time delayed signal C and;

whereby the relationship of time, gain and phase imparts a simulated stereophonic output which contains little, if any, additional reverberation as compared to the monaural input signal.

14. Apparatus for producing a two channel simulated stereophonic output from a monaural input which has initially been divided into three equal signals; A, B, and C, comprising:

a) means for providing tone control of signal A;
b) means for providing gain control of tone controlled signal A;
c) means for providing tone control of signal B;
d) means for providing gain control of tone controlled signal B;
e) means for imparting time delay to signal C;
f) means for providing tone control of delayed signal C;
g) means for providing gain control of tone controlled signal C;
h) means for dividing tone and gain controlled signal C into equal signals, D and E;
i) means for inverting signal E. 180 degrees with respect to signal D;
j) means for mixing said tone and gain controlled signal A and said signal D to produce a first one of said simulated stereophonic channel outputs and;
k) means for mixing said tone and gain controlled signal B and said phase inverted signal E to produce a second one of said simulated stereophonic channel outputs.

whereby the relationship of time, gain, phase and tone imparts a simulated stereophonic output which contains little, if any, additional reverberation as compared to the monaural input signal.

15. Apparatus for producing a two channel simulated stereophonic output from a monaural input which has initially been divided into two equal signals; A and B, comprising:

a) means for providing tone control of signal A;
b) means for providing gain control of tone controlled signal A;
c) means for dividing tone and gain controlled signal A into equal signals, C and D;
d) means for inverting signal C 180 degrees with respect to signal D;
e) means for imparting time delay to signal B;
f) means for dividing signal B into equal signals, E and F;
g) means for providing tone control of signal E;
h) means for providing gain control of tone controlled signal E;
i) means for providing tone control of signal F;
j) means for providing gain control of tone controlled signal F;
k) means for mixing said phase inverted signal C and said tone and gain controlled signal E to produce first one of said simulated stereophonic channel outputs and;

l) means for mixing said signal D and said tone and gain controlled signal F to produce second one of said simulated stereophonic channel outputs.

wherein said tone and gain controlled signal A is the signal of least amplitude and;

whereby the relationship of time, gain, phase and tone imparts a simulated stereophonic output which contains little, if any, additional reverberation as compared to the monaural input signal.

16. Apparatus for producing a two channel simulated stereophonic output from a monaural input which has initially been divided into three equal signals; A, B and C, comprising:

a) means for providing tone control of signal A;

b) means for providing gain control of tone controlled signal A;

c) means for dividing tone and gain controlled signal A into equal signals, D and E;

d) means for inverting signal E 180 degrees with respect to signal D;

e) means for imparting time delay to signal B;

f) means for dividing signal B into equal signals, F and G;

g) means for providing tone control of signal F;

h) means for providing gain control of tone controlled signal F;

i) means for providing tone control of signal G;

j) means for providing gain control of tone controlled signal G;

k) means for imparting time delay to signal C;

l) means for providing tone control of delayed signal C;

m) means for providing gain control of tone controlled signal C;

n) means for dividing gain controlled signal C into equal signals, H and I;

o) means for inverting signal I 180 degrees with respect to signal H;

p) means for mixing said signal D, said tone and gain controlled signal F and said signal H to produce first one of said simulated stereophonic channel outputs and;

q) means for mixing phase inverted signal E, said tone and gain controlled signal G and said phase inverted signal I to produce second one of said simulated stereophonic channel outputs.

wherein said tone and gain controlled signal A is the signal of least amplitude and wherein said time delayed signal B is imparted with less delay value than is said time delayed signal C and;

whereby the relationship of time, gain and phase imparts simulated stereophonic output, with little, if any, addition to reverberative content of the monaural signal.

17. Apparatus for producing a two channel simulated stereophonic output from a monaural input which has initially been divided into four equal signals; A, B, C and D, comprising;

a) means for providing tone control of signal A;

b) means for providing gain control of tone controlled signal A;

c) means for imparting time delay to signal B;

d) means for providing tone control of delayed signal B;

e) means for providing gain control of tone controlled signal B;

f) means for dividing gain controlled signal B into equal signals, E and F;

g) means for inverting signal F 180 degrees with respect to signal E;

h) means for imparting time delay to signal C;

i) means for providing tone control of delayed signal C;

j) means for providing gain control of tone controlled signal C;

k) means for dividing signal C into equal signals, G and H;

l) means for inverting signal H 180 degrees with respect to signal G;

m) means for providing tone control of signal D;

n) means for providing gain control of tone controlled signal D;

o) means for mixing said tone and gain controlled signal A, said signal E, and said signal G to produce first one of said simulated stereophonic channel outputs and;

p) means for mixing phase inverted signal F, said phase inverted signal H and said tone and gain controlled signal D to produce second one of said sumulated stereophonic channel outputs;

wherein said tone and gain controlled signals A and D are the signals of least amplitude and wherein said time delayed signal B is imparted with less delay value than is said time delayed signal C and;

whereby the relationship of time, gain, phase and tone imparts a simulated stereophonic output which contains little, if any, additional reverberation as compared to the monaural input signal.

18. Apparatus defined by claim 11 wherein said single channel monaural input has been further divided as to provide a fourth monaural signal, F, which is equal to said signals A, B and C, said apparatus further comprising:

a) means for imparting time delay to signal F;

b) means for providing gain control of delayed signal F;

c) means for dividing gain controlled signal F into equal signals, G and H;

d) means for inverting signal H 180 degrees with respect to signal G;

e) means for providing signal G as a third channel output signal and;

f) means for providing signal H as a fourth channel output signal;

wherein said signal D is imparted with a great delay than any of the other signals.

whereby the relationship of time, gain and phase imparts a simulated quadraphonic or surround sound output which contains little, if any, additional reverberation as compared to the monaural input signal.

19. Apparatus defined by any one of claims 10 to 13, 14–16, or 17 further including a phase inversion circuit selector means whereby an output having a 180 degree phase inversion can be provided in one of said simulated stereophonic output channels.

20. Apparatus for producing a two channel simulated stereophonic output from a monaural input which has initially been divided into four equal signals; A, B, C and D, comprising:

a) means for inverting signal A 180 degrees with respect to signal D;

b) means for providing gain control of inverted signal A;

c) means for imparting time delay to signal B;

d) means for dividing delayed signal B into equal signals, E and F;
e) means for providing gain control of signal E;
f) means for providing gain control of signal F;
g) means for imparting time delay to signal C;
h) means for dividing delayed signal C into equal signals, G and H;
i) means for inverting signal G 180 degrees with respect to signal H;
j) means for providing gain control of inverted signal G;
k) means for providing gain control of signal H;
l) means for providing gain control of signal D;
m) means for mixing said phase inverted, gain controlled signal A, said gain controlled signal E and said phase inverted, gain controlled signal G to produce a first one of the simulated stereophonic channel outputs and ;
n) means for mixing said gain controlled signal F, said gain controlled signal H and said gain controlled signal D to produce a second one of the simulated stereophonic channel outputs.

wherein said time delayed signal C is imparted with a smaller value than is said time delayed signal B and;

whereby the relationship of time, gain and phase imparts a simulated stereophonic output which contains little, if any, additional reverberation as compared to the monaural input signal.

21. Apparatus for producing a two channel simulated stereophonic output from a monaural input which has initially been divided into three equal signals; A, B and C, comprising:

a) means for providing tone control of signal A;
b) means for providing gain control of tone controlled signal A;
c) means of dividing signal A into signals D and E;
d) means for inverting signal D 180 degrees with respect to signal E;
e) means for switching signals D and E to opposing output channels;
f) means for imparting time delay to signal B;
g) means for providing gain controlled balance of delayed signal B into signals F and G;
h) means for imparting time delay to signal C;
i) means for providing tone control of delayed signal C;
j) means for providing gain control of tone controlled signal C;
k) means for dividing gain controlled signal C into equal signals, H and I;
l) means for inverting signal I 180 degrees with respect to signal H;
m) means for mixing said signal E, said signal F and said signal H to produce a first one of the simulated stereophonic channel outputs and;
n) means for mixing said phase inverted signal D, said signal G and said phase inverted signal I to produce a second one of the simulated stereophonic channel outputs;
o) or, in accordance with e above, means for mixing said phase inverted signal D, said signal F and said signal H to produce a first one of the simulated stereophonic channel outputs and;
p) means for mixing said signal E, said signal G and said phase inverted signal I to produce a second one of the simulated stereophonic channel outputs;

wherein said time delayed signal C is imparted with a smaller delay value than is said time delayed signal B and;

whereby the relationship of time, gain and phase imparts simulated stereophonic output, with little, if any, addition to reverberative content.

* * * * *